US006705256B2

(12) United States Patent
Yamaki et al.

(10) Patent No.: US 6,705,256 B2
(45) Date of Patent: Mar. 16, 2004

(54) VALVE TIMING CONTROL SYSTEM FOR INTERNAL COMBUSTION ENGINE

(75) Inventors: Toshihiro Yamaki, Saitama-ken (JP); Hidetaka Ozawa, Saitama-ken (JP); Hisao Sakai, Saitama-ken (JP); Kenji Abe, Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/390,912

(22) Filed: Mar. 19, 2003

(65) Prior Publication Data

US 2003/0183183 A1 Oct. 2, 2003

(30) Foreign Application Priority Data

Mar. 29, 2002 (JP) ..... 2002-097254

(51) Int. Cl.[7] ..... F01L 9/04

(52) U.S. Cl. ..... 123/90.11; 123/90.15; 123/90.16; 123/90.44; 361/139; 361/152; 361/160

(58) Field of Search ..... 123/90.11, 90.15–90.17, 123/90.27, 90.31, 90.44–90.46; 361/143, 144, 146, 159, 160, 194, 195, 139, 152, 154, 187; 251/129.03, 129.09, 129.15, 129.16, 129.2, 251, 263; 335/15, 155, 170, 171, 190, 192, 253, 257, 277

(56) References Cited

U.S. PATENT DOCUMENTS 4,870,930 A 10/1989 Yagi ..... 123/90.11
5,889,405 A * 3/1999 Yanai et al. ..... 324/522
6,081,413 A 6/2000 Schmitz et al. ..... 361/160
6,386,158 B1 * 5/2002 Takahashi ..... 123/90.15
6,549,390 B1 * 4/2003 Ozawa et al. ..... 361/139

FOREIGN PATENT DOCUMENTS

| | | |
|---|---|---|
| DE | 40 35 376 A1 | 5/1991 |
| DE | 44 19 768 A1 | 1/1995 |
| EP | 1 022 442 A2 | 7/2000 |
| GB | 2 322 410 A | 8/1998 |

* cited by examiner

*Primary Examiner*—Thomas Denion
*Assistant Examiner*—Kyle Riddle
(74) *Attorney, Agent, or Firm*—Arent Fox Kintner Plotkin & Kahn, PLLC

(57) ABSTRACT

A valve timing control system for an internal combustion engine is provided which is capable of ensuring reliable holding of a valve by an actuator, and attaining energy saving by efficient operation of the actuator. The valve timing control system controls valve-closing timing of a valve opened by a cam provided on a camshaft, by temporarily holding the valve. A response delay of the actuator is predicted as a response delay prediction value. Output timing is set in which a drive signal for driving the actuator is output, according to the predicted response delay prediction value. Holding timing is controlled in which the valve is held by the actuator, by outputting the drive signal to the actuator, based on the set output timing.

18 Claims, 14 Drawing Sheets

FIG. 7

| | Ne |
|---|---|
| VB | tStart11 ····· tStart1m<br>⋮ ⋱ ⋮<br>tStartn1 ····· tStartnm |

VALVE TIMING CONTROL SYSTEM FOR INTERNAL COMBUSTION ENGINE

BACKGROUND OF THE INVENTION

1. Field of the Invention

This invention relates to a valve timing control system for an internal combustion engine, which controls timing for closing a valve opened by a cam provided on a camshaft of the engine by temporarily holding the valve by an actuator.

2. Description of the Prior Art

Conventionally, a valve timing control system of this kind has been proposed e.g. in Japanese Laid-Open Patent Publication (Kokai) No. 63-289208. This valve timing control system opens and closes engine valves by cams provided on a camshaft via rocker arms, and includes holding mechanisms for holding the engine valves in respective open positions. The holding mechanisms are each implemented by a solenoid actuator comprised of a solenoid fixed to the cylinder head and an armature fixed to a valve stem of an engine valve. The energization of the coil of the solenoid is controlled by a control unit. The armature is arranged in a manner opposed to the solenoid such that when the engine valve is actuated to the open position by the cam, there is a slight spacing between the armature and the solenoid. When the engine valve reaches the open position, the solenoid is energized in a manner dependent on an operating condition of the engine, whereby an attractive force of the solenoid is exerted on the armature to hold the engine valve in the open position over a predetermined time period corresponding to duration of the energization. Thus, the timing for closing the engine valve is delayed, i.e. the valve-closing timing is controlled.

In the conventional valve timing control system, however, there occurs a response delay between a time an instruction is delivered for holding the engine valve and a time a holding operation is actually carried out on the engine valve. The response delay makes it difficult to hold the engine valve in desired timing. Particularly, in this valve timing control system, the solenoid actuator is driven when the engine valve reaches the open position by the operation of the cam, and therefore, when the operating condition changes, there is a fear that the engine valve cannot be held in desired timing due to the delayed response of the solenoid actuator, making it impossible to achieve a desired valve lift curve or even hold the engine valve. In such a case, the combustion state is degraded to adversely affect exhaust emissions. Particularly, the response of the solenoid actuator is delayed by a time period the magnetic flux takes to rise. Further, the rise of the magnetic flux becomes slower as the power supply voltage is lower, and becomes relatively slower with respect to the operating speed of the engine valve as the engine rotational speed is higher. This increases the possibility of failure in holding the engine valve. Further, if a hydraulic actuator is employed for the mechanism for holding the engine valve, instead of the solenoid actuator, the rise in the hydraulic pressure becomes slower as the oil temperature is lower. Further, as the engine rotational speed is higher, the response of the holding mechanism becomes slower, which can also increase the possibility of failure in holding the engine valve.

SUMMARY OF THE INVENTION

It is an object of the invention to provide a valve timing control system for an internal combustion engine, which is capable of properly holding a valve in predetermined holding timing by an actuator. It is a further object of the invention to provide a valve timing control system for an internal combustion engine, which can attain energy saving by efficient operation of the actuator, when the actuator is formed by a solenoid actuator.

To attain the above object, the invention provides a valve timing control system for an internal combustion engine, for controlling valve-closing timing of a valve opened by a cam provided on a camshaft, by temporarily holding the valve, the valve timing control system comprising:

an actuator for holding the valve;

response delay-predicting means for predicting a response delay of the actuator by a response delay prediction value;

output timing-setting means for setting output timing in which a drive signal for driving the actuator is output, according to the predicted response delay prediction value; and holding timing control means for controlling holding timing in which the valve is held by the actuator, by outputting the drive signal to the actuator, based on the set output timing.

According to this valve timing control system, the response delay of the actuator is predicted by a response delay prediction value, and output timing in which the drive signal for driving the actuator is output is set according to the predicted response delay prediction value. Further, holding timing in which the valve is held by the actuator is controlled by outputting the drive signal to the actuator, based on the set output timing. Therefore, the operation of the actuator can be started in proper timing dependent on the predicted response delay of the actuator, which makes it possible to properly hold the valve in predetermined appropriate holding timing while compensating for the response delay of the actuator and enabling efficient operation of the actuator.

Preferably, the valve timing control system further comprises operating condition-detecting means for detecting an operating condition of the engine, and the response delay-predicting means predicts the response delay of the actuator according to the detected operating condition of the engine.

According to this preferred embodiment, it is possible to predict the response delay of the actuator according to the detected operating condition of the engine. Therefore, the operation of the actuator can be started in appropriate timing dependent on actual operating conditions of the engine, which makes it possible to properly hold the valve in predetermined holding timing while causing the actuator to efficiently operate without delay in operation.

More preferably, the operating condition-detecting means includes rotational speed-detecting means for detecting a rotational speed of the engine as the operating condition of the engine, and the response delay-predicting means sets the response delay prediction value to a larger value as the detected rotational speed of the engine is higher.

According to this preferred embodiment, as the rotational speed of the engine is higher, the operation of the actuator is started earlier, and hence even when the engine is in a high rotational speed condition, the valve can be more properly held without causing relative delay in operation of the actuator in spite of a high operating speed of the valve.

Preferably, the valve timing control system further comprises drive source condition-detecting means for detecting a condition of a drive source of the actuator, and the response delay-predicting means predicts the response delay of the actuator, according to the detected condition of the drive source.

As described hereinbefore, when the actuator is a solenoid actuator, the rise of the magnetic flux of the electromagnet of the actuator varies depending on the voltage of the power supply, while when the actuator is a hydraulic actuator, the rise of the oil pressure varies depending on the oil temperature of an oil pressure source. Thus, the rise time or start of the actuator varies depending on the condition of the drive source. According to this preferred embodiment, it is possible to predict the response delay of the actuator according to the detected condition of the drive source, thereby starting the operation of the actuator in appropriate timing dependent on the actual condition of the drive source.

More preferably, the actuator is formed by a solenoid actuator, and the drive source condition-detecting means includes power supply voltage-detecting means for detecting a voltage of a power source of the solenoid actuator, as the condition of the drive source, the response delay-predicting means setting the response delay prediction value to a larger value as the detected voltage of the power source is lower.

According to this preferred embodiment, when the actuator is a solenoid actuator, the operation of the solenoid actuator is started earlier as the voltage of the power source is lower. This makes it possible to hold the valve in predetermined appropriate holding timing without delay in operation of the solenoid actuator, even when the voltage of the power source is low.

Further preferably, the solenoid actuator includes an armature that is moved to follow motion of the valve when the valve is lifted by the cam in a valve-opening direction, and an electromagnet that is energized when the armature is close thereto, by electric power supplied as the drive signal from the power source, to thereby attract the armature thereto to hold the valve, and the holding timing control means controls the electric power supplied to the electromagnet by constant voltage before the valve is held, and by constant current after the valve is held.

When a valve is actuated by a cam in the valve-opening direction, the valve displacement speed can be made slower by a disturbance, such as frictional resistance and biting of wear particles, causing a decrease in the lift of the valve, which makes it impossible to obtain predetermined lifting timing. On the other hand, this preferred embodiment of the invention is configured such that when the valve is opened, the valve is held by causing the armature following the motion of the valve to be attracted to the electromagnet, and hence, it is necessary for the armature to be close to the electromagnet when the holding of the valve is executed. Therefore, in case a decrease in the valve lift occurs owing to such a disturbance described above, the armature can be positioned too far from the electromagnet when the valve is to be held, which makes it impossible for the electromagnet, which is energized at this time, to attract the armature thereto, resulting in an error in holding of the valve (loss of synchronization).

On the other hand, the inductance L of the coil of the electromagnet is expressed by the equation: $L=N\cdot\Delta\phi/\Delta i$ (N: the number of windings of the coil; ø: magnetic flux; i: electric current). Therefore, as the distance between the armature and the electromagnet is smaller, the inductance L is larger. Further, the electric current i is expressed by the equation: $i=E/R(1-\exp(-R/L\cdot t))$ (E: power supply voltage; R: resistance of the coil), and finally converges to a value of E/R. A converging time period over which the electric current converges to the value of E/R is larger as the inductance L is larger.

From the relationship described above, when a decrease in the valve lift occurs due to the disturbance, the distance between the armature and the electromagnet becomes larger than usual, resulting in a decreased value of the inductance L. Accordingly, the converging time period over which the electric current i converges is shortened to cause the current to flow more easily to increase the current i flowing through the coil of the electromagnet. As a result, a larger attractive force than usual acts on the armature, so that even if the armature is far from the electromagnet to some extent, it can be properly attracted to the electromagnet.

Therefore, as in the case of this preferred embodiment, if the energization of the electromagnet is controlled by constant voltage before the valve is held, it is possible to allow an increase in the current i which becomes easier to flow. As a result, the attractive force of the electromagnet is increased, so that the armature can be attracted to the electromagnet even if the armature is far from the electromagnet to some extent, whereby the valve can be positively held. Thus, by supplying over excitation current to the electromagnet by constant-voltage control before the valve is held, the valve timing control system can be made tough against the disturbance, whereby the valve can be held in a further appropriate manner. In contrast, if constant-current control is carried out before the valve is held, the current is limited so as to allow only a predetermined or lower amount of current to flow, so that if the armature is not within a predetermined distance of the electromagnet due to a decreased valve lift caused by the disturbance, there is a fear that the failure of holding of the valve can occur.

Further, once the valve is held, the armature is attracted at the electromagnet so that the distance between the two becomes constant. Therefore, in this state, by controlling the energization by constant current (holding current), it is possible to continue positive holding of the valve and at the same time reduce the power consumption.

Preferably, the response delay-predicting means calculates an output start offset time period by which a start of output of the drive signal to the actuator is shifted, as the response delay prediction value, and the output timing-setting means includes an output start timer that counts up to a time going back from a reference time corresponding to a predetermined reference crank angle position by the output start offset time period, thereby causing the drive signal to start to be output to the actuator at the time.

According to this preferred embodiment, the output start offset time period is calculated as the response delay prediction value, and the output start timer counts up to a time going back from a reference time corresponding to a predetermined reference crank angle position by the output start offset time period, thereby causing the drive signal to start to be output to the actuator at the time. This makes it possible to cause the drive signal to start to be delivered in appropriate timing with accuracy, in synchronism with the rotation of the cam, and cause the operation for holding the valve to be properly completed by the time the reference crank angle position is reached.

The above and other objects, features, and advantages of the invention will become more apparent from the following detailed description taken in conjunction with the accompanying drawings.

BRIEF DESCRIPTION OF THE DRAWINGS

FIG. 7 is a diagram showing an example of a map for determining an energization start offset time period;

DETAILED DESCRIPTION OF PREFERRED EMBODIMENT

Figure 1:
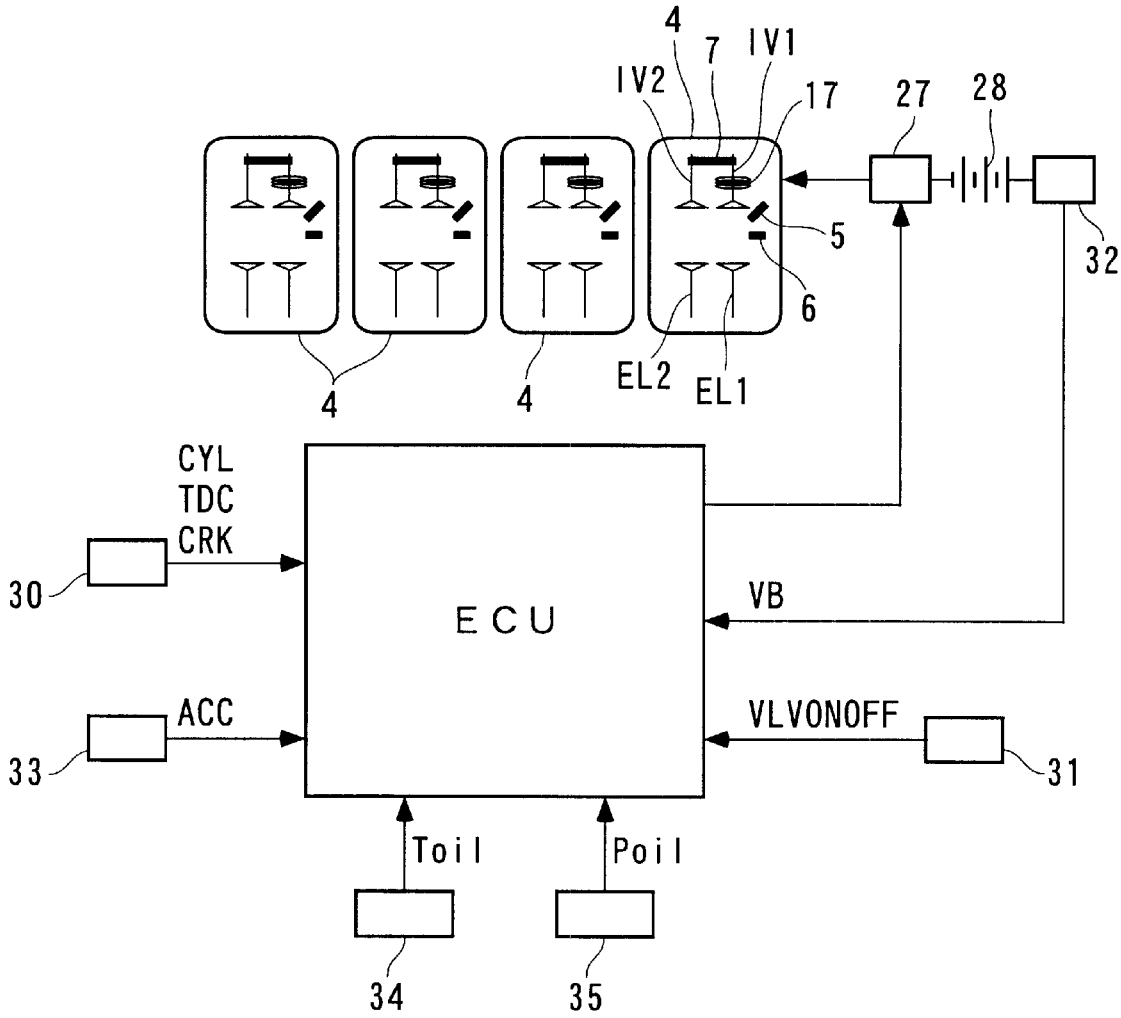
FIG. 1 is a block diagram schematically showing the arrangement of a valve timing control system for an internal combustion engine, according to an embodiment of the invention.
Figure 2:
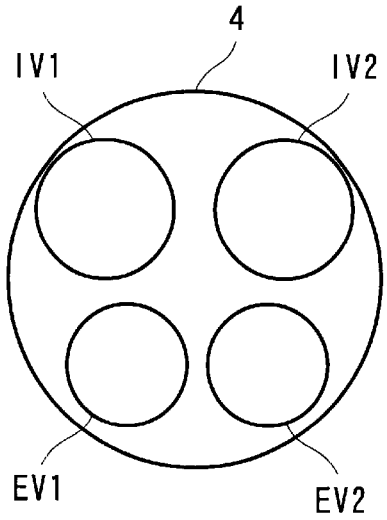
FIG. 2 is a diagram showing the arrangement of intake valves and exhaust valves.

Hereafter, a valve timing control system for an internal combustion engine, according an embodiment of the invention, will be described with reference to the drawings. FIG. 1 schematically shows the arrangement of an internal combustion engine incorporating a valve timing control system to which the present invention is applied. The illustrated internal combustion engine (hereinafter referred to as "the engine") 3 is a four-cylinder in-line DOHC gasoline engine installed on a vehicle, not shown. Each cylinder 4 is provided with first and second intake valves IV1, IV2, and first and second exhaust valves EV1, EV2 (see FIG. 2), and further with an injector 5 for injecting fuel into an intake port 3*a* and a spark plug 6 for igniting the air-fuel mixture.

Figure 3:
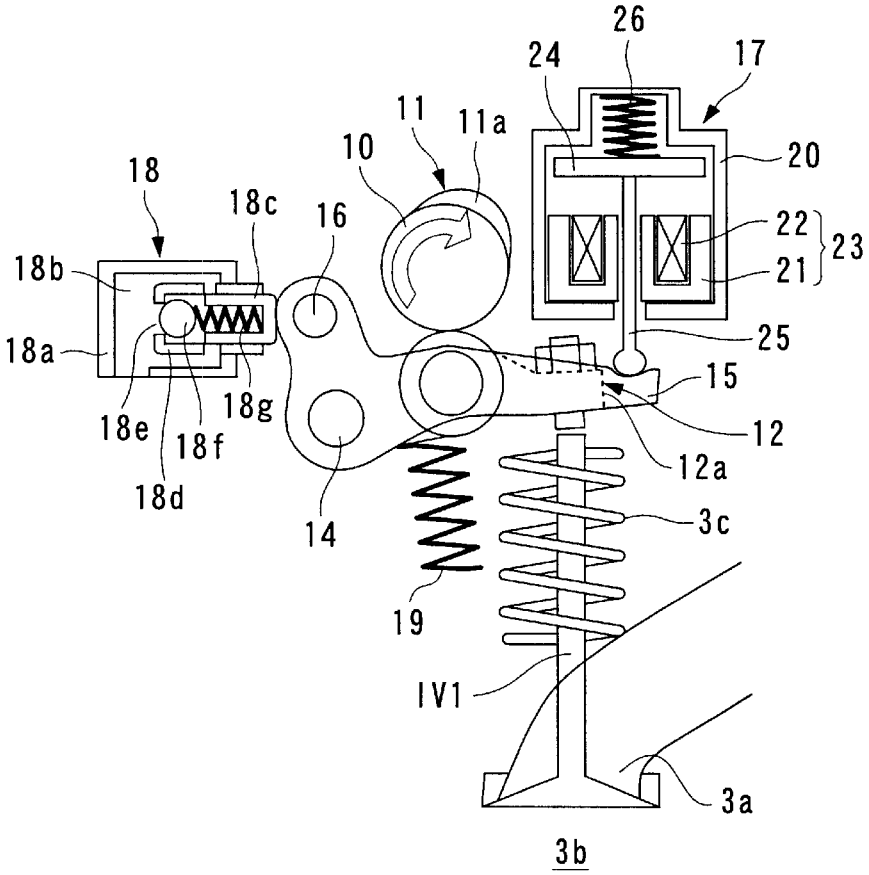
FIG. 3 is a side view of an intake valve and a valve timing control system.

As illustrated in FIG. 3 showing an example of the first intake valve IV1, each of the intake valves IV1, IV2 is arranged such that it is movable between a closed position (shown in FIG. 3) in which the intake port 3*a* is closed and an open position (not shown) in which the intake port 3*a* is open due to projection of the intake valve into a combustion changer 3*b*, and is always urged by a valve spring 3*c* toward the closed position. Further, the intake valves IV1, IV2 are actuated by a cam-type valve actuating mechanism 7, and valve-closing timing of the first intake valve IV1 is variably controlled by the valve timing control system 1 according to the invention.

The cam-type valve actuating mechanism 7 is comprised of a camshaft 10, an intake cam 11 (cam) integrally formed with the camshaft 10, and a rocker arm 12 which is actuated by the intake cam 11 for pivotal motion to thereby convert the rotating motion of the camshaft 10 into reciprocating motion of the intake valves IV1, IV2. The camshaft 10 is connected to a crankshaft, not shown, of the engine 3 via a driven sprocket and a timing chain (none of which is shown), and driven by the crankshaft such that it performs one rotation per two rotations of the crankshaft in synchronism therewith.

Further, the cam-type valve actuating mechanism 7 is capable of switching between cam profiles of the intake cam 11. More specifically, it is configured as follows: The intake cam 11 is comprised of a low-speed cam 11*a*, a high-speed cam (not shown) higher in cam profile than the low-speed cam 11*a*, and an inactive cam (not shown) having a very low cam nose, arranged on the camshaft 10 in the mentioned order. The rocker arm 12 is comprised of a low-speed rocker arm 12*a*, a high-speed rocker arm (not shown), and an inactive rocker arm (not shown), arranged in a manner associated with the low-speed cam 11*a*, the high-speed cam, and the inactive cam, respectively. These rocker arms each have one end thereof pivotally mounted on a rocker shaft 14, and the low-speed rocker arm 12*a* and the inactive rocker arm are in abutment with the upper ends of the first intake valve IV1 and the second intake valve IV2, respectively. Further, an oil pressure-switching mechanism (not shown) switches a state of connection of the low-speed rocker arm 12*a* and the inactive rocker arm, with the high-speed rocker arm, between a connected state and a disconnected state. The operation of the oil pressure-switching mechanism is controlled by an ECU 2 (see FIG. 1).

Figure 5:
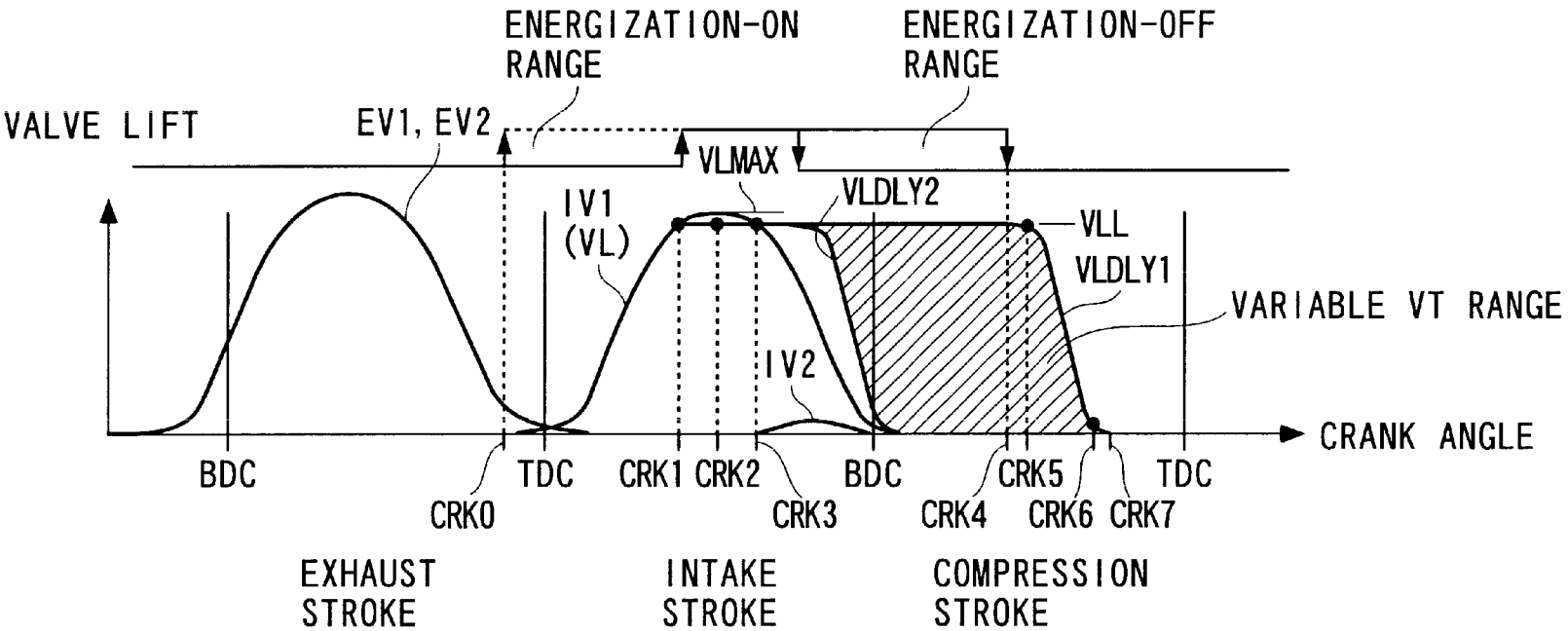
FIG. 5 is a timing chart of operations of inlet and outlet exhaust valves by cam-type valve actuating mechanisms and the valve timing control system.

Due to the above configuration, when the oil pressure-switching mechanism sets the state of connection to the disconnected state, these three rocker arms are disconnected from each other and capable of pivotal motion independently of each other. As a result, as the camshaft 10 rotates, the low-speed rocker arm 12*a* is actuated by the low-speed cam 11*a*, whereby the first intake valve IV1 is opened and closed in low-speed valve timing dependent on the cam profile of the low-speed cam 11*a*. For instance, as represented by a valve lift curve VL shown in FIG. 5, the first intake valve IV1 starts to be opened, slightly before a TDC position from which the intake stroke starts, and the closing of the valve is terminated, slightly after a BDC position from which the compression stroke starts. On the other hand, as the inactive rocker arm is actuated by the inactive cam, the second intake valve IV2 is opened and closed with a slight valve lift in inactive valve timing dependent on the cam profile of the inactive cam. For instance, as shown in FIG. 5, it is opened with a slight valve lift at a terminating stage of the intake stroke. In this operation mode of the intake valves IV1, IV2, a swirl is produced in the cylinder 4, flowing from the first intake valve IV1 toward the second intake valve IV2, which ensures stable combustion of the air-fuel mixture even when the mixture is lean.

On the other hand, when the oil pressure-switching mechanism sets the state of connection to the connected state, the low-speed rocker arm 12*a* and the inactive rocker arm are connected to the high-speed rocket arm (not shown), and the three arms are pivotally moved in unison. As a result, in accordance with rotation of the camshaft 10, the low-speed rocker arm 12*a* and the inactive rocker arm are actuated by the high-speed cam having the highest cam nose, via the high-speed rocker arm, whereby the first and second intake valves IV1, IV2 are both opened and closed in high-speed valve timing dependent on the cam profile of the high-speed cam. In this operation mode, the first and second intake valves IV1, IV2 are both opened and closed with a large valve lift whereby the intake air amount is increased to generate a larger engine power output.

Further, although not shown, a cam-type valve actuating mechanism for actuating the first and second exhaust valves EV1, EV2 is comprised of an exhaust camshaft, an exhaust cam integrally formed with the exhaust camshaft, an exhaust rocker arm (not shown), and so forth. The exhaust valves EV1, EV2 are opened and closed with a valve lift and in opening and closing timings, in dependence on the cam profile of the exhaust cam. For instance, as shown in FIG. 5, the exhaust valves EV1, EV2 start to be opened when the cylinder is in a crank angle position slightly before a BDC position from which the exhaust stroke starts, and the closing of the valves is terminated, slightly after the TDC position from which the intake stroke starts.

As shown in FIG. 3, the valve timing control system 1 includes a rocker arm 15 (hereinafter referred to as "the EMA rocker arm") associated with a solenoid actuator 17, referred to hereinafter, which is located adjacent to the low-speed rocker arm 12*a* and pivotally mounted on the rocker shaft 14, an EMA oil pressure-switching mechanism 16 for switching the state of connection of the EMA rocker arm 15 with the low-speed rocker arm 12*a* between a connected state and a disconnected state, a solenoid actuator (hereinafter referred to as "the EMA") 17 as an actuator for effecting blocking engagement with the first intake valve IV1 having been opened, via the EMA rocker arm 15 and the low-speed rocker arm 12*a*, thereby holding the first intake valve IV1, the ECU 2 for controlling the operations of the EMA oil pressure-switching mechanism 16 and the EMA 17, a hydraulic impact-reducing mechanism 18 for reducing an impact on the first intake valve IV1 caused by the operation of the EMA 17, and a lost-motion spring 19 for holding the EMA rocker arm 15 in a predetermined angle position when the EMA rocker arm 15 is disconnected from the low-speed rocker arm 12*a*.

In the disconnected state set by the EMA oil pressure-switching mechanism 16, the EMA rocker arm 15 and the low-speed rocker arm 12*a* are disconnected from each other, and capable of pivotal motion independently of each other, whereas in the connected state set by the same, they are connected to each other and pivotally moved in unison.

Figure 4:
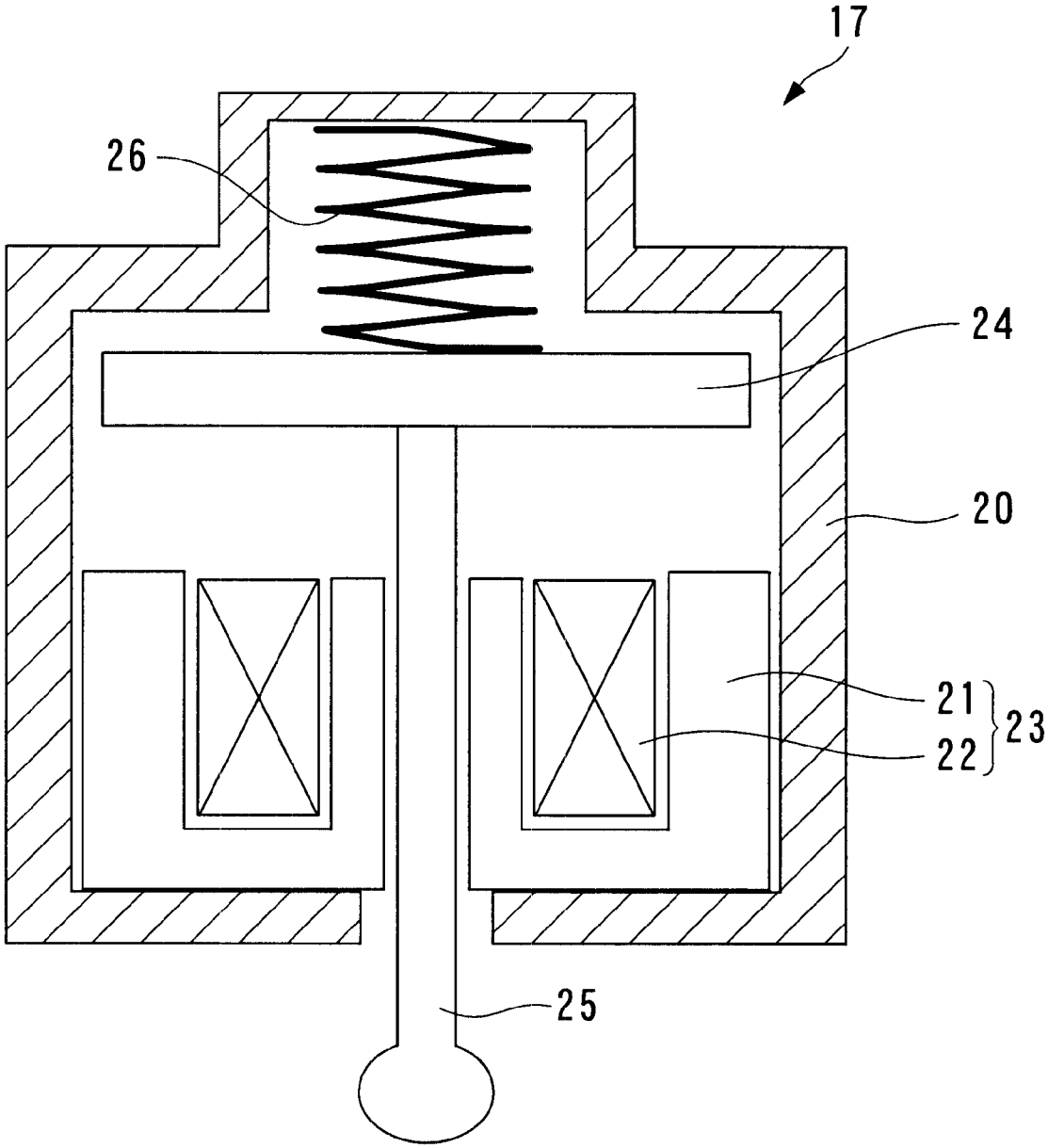
FIG. 4 is a cross-sectional view of a solenoid actuator.

As shown in FIG. 4, the EMA 17 is comprised of a casing 20, an electromagnet 23 formed by a yoke 21 and a coil 22 received in a lower space within the casing 20, an armature 24 received above them, a stopper rod 25 (stopper) integrally formed with the armature 24 and extending downward through the electromagnet 23 and the casing 20 to the vicinity of the EMA rocker arm 15, and a follow-up coil spring 26 for urging the armature 24 downward such that the armature 24 follows motion of the EMA rocker arm 15.

The coil 22 of the electromagnet 23 is connected to the ECU 2 via an energization switch 27 (see FIG. 1), and the ECU 2 controls the motion of the EMA 17 through control of the energization of the coil 22 by power supplied from a power source 28. Further, the ECU 2 is capable of performing this energization control such that it can be switched between constant-voltage control and constant-current control. Further, spacing between the yoke 21 and the armature 24 is configured such that when the first intake valve IV1 reaches a predetermined valve lift VLL immediately before the maximum valve lift VLMAX (e.g. 0.3 mm shorter than the maximum valve lift VLMAX), the armature 24 is seated on the yoke 21. Further, the spring force of the follow-up coil spring 26 urging the armature 24 downward is set to a smaller value than that of the lost-motion spring urging the EMA rocker arm 15 upward.

Now, the opening and closing operations of the first intake valve IV1 controlled by the valve timing control system 1 will be described with reference to FIG. 5. First, in the disconnected state set by the EMA oil pressure-switching mechanism 16, the low-speed rocker arm 12*a* is disconnected from the EMA rocker arm 15, so that the first intake valve IV1 is actuated only by the cam-type valve actuating mechanism 7 independently of the operation of the EMA 17. As a result, in low-speed valve timing, the first intake valve IV1 starts to be opened, slightly before the TDC position from which the intake stroke starts, reaches the maximum valve lift VLMAX at a crank angle of 90 degrees after the TDC position, and is completely closed, slightly after the BDC position from which the compression stroke starts. Further, in the disconnected state, the EMA rocker arm 15 is urged upward by the spring force of the lost-motion spring 19 which overcomes the spring force of the follow-up coil spring 26, whereby the EMA rocker arm 15 is held in a predetermined angle position in which it can be connected to the low-speed rocker arm 12*a*.

On the other hand, when operating conditions set to the ECU 2 are satisfied, to attain the optimum valve-closing timing for the operating conditions, the valve timing control system 1 is operated. In this case, the EMA oil pressure-switching mechanism 16 connects the EMA rocker arm 15 to the low-speed rocker arm 12*a*. In this state, when the valve-opening and closing operation by the intake cam 11 is started, during motion of the first intake valve IV1 in the lifting or valve-opening direction, the EMA rocker arm 15 is actuated downward by the intake cam 11 against the urging force of the lost-motion spring 19, and accordingly, the armature 24 and the stopper rod 25 are lifted (moved downward in the figure) by the spring force of the follow-up coil spring 26 in a fashion following the EMA rocker arm 15. Further, in parallel with this, electric current starts to be passed through the coil 22 of the electromagnet 23 to energize the electromagnet 23. Then, when the first intake valve IV1 reaches the predetermined valve lift VLL immediately before the maximum valve lift VLMAX, the armature 24 is seated on the yoke 21 (CRK1 in FIG. 5).

After the armature 24 is seated, the EMA rocker arm 15 leaves the stopper rod 25, and the first intake valve IV1 is lifted according to the cam profile of the low-speed cam 11*a*. Then, by the time the first intake valve IV1 is brought into abutment with the stopper rod 25 again after reaching the maximum valve lift (CRK3 in FIG. 5), the held state of the armature 24 by the attractive force of the yoke 21 is established (CRK2 in FIG. 5), so that the armature 24 maintains the state seated on the yoke 21 by the attractive force of the yoke 21 which overcomes the urging force of the valve spring 3*c* of the first intake valve IV1. As a result, the first intake valve IV1 is brought into blocking (or catching) engagement with the stopper rod 25 via the low-speed rocker arm 12*a* and the EMA rocker arm 15, and held in an open state at a predetermined valve lift (hereinafter referred to as "the holding lift") VLL.

Further, thereafter, the valve lift VL of the first intake valve IV1 is held at the holding lift VLL until the energization of the electromagnet 23 is stopped, whereby the low-speed cam 11*a* leaves the low-speed rocker arm 12*a* to freely rotate. Then, when the energization of the electromagnet 23 is stopped (CRK4), the attractive force acting on the armature 24 is decreased to be overcome by the spring force of the valve spring 3*c* so that the armature 24 leaves the yoke 21, whereby the holding of the first intake valve IV1 by the EMA 17 is cancelled (CRK5). Then, the first intake valve IV1 is moved by the spring force of the valve spring 3*c* toward the valve-closing position according to the valve lift curve VLDLY1. Then, at a crank angle position (CRK6) slightly before the valve-closing position, the hydraulic impact-reducing mechanism 18 starts to operate to reduce the displacement speed of the first intake valve IV1, whereby the first intake valve IV1 finally reaches the valve-closing position with a reduced impact (CRK7).

It should be noted that the illustrated valve lift curve VLDLY 1 referred to hereinabove represents a case in which the energization of the electromagnet 23 is stopped in latest timing, and the valve lift curve VLDLY2 shown in FIG. 5 represents a case in which the energization is stopped in earliest timing. More specifically, a hatched area enclosed by the valve lift curves VLDLY1, VLDLY2 represents a valve closing timing range to which the closing of the first intake valve IV1 can be delayed by the valve timing control system 1 (hereinafter referred to as "variable VT range"). As described above, the operation of the EMA 17 makes it possible not only to close the first intake valve IV1 later than when the first intake valve IV1 is actuated by the intake cam 11, and but also to control the closing timing of the first intake valve IV1 as desired by controlling the timing of turning-off of the electromagnet 23.

The hydraulic impact-reducing mechanism 18 reduces the impact applied to the first intake valve IV1 when it is closed upon cancellation of the holding of the same by the EMA 17. As shown in FIGS. 3 and 4, the hydraulic impact-reducing mechanism 18 is comprised of a casing 18*a* defining an oil chamber 18*b* therein, a piston 18*c* horizontally slidably inserted into the oil chamber 18*b* with one end protruding out from the casing 18*a*, a valve chamber 18*d* provided within the oil chamber 18*b* and formed with a port 18*e* on a side remote from the piston 18*c*, a ball 18*f* received within the valve chamber 18*d*, for opening and closing the port 18*e*, and a coil spring 18*g* interposed between the ball 18*f* and the piston 18*c*, for urging the piston 18*c* outward. The piston 18*c* is in abutment with an upward-extending portion of the EMA rocker arm 15 on an opposite side to a portion of the EMA rocker arm with which the stopper rod 25 of the EMA 17 abuts.

According to this configuration, the hydraulic impact-reducing mechanism 18 is in a state shown in FIG. 3 when the intake valve IV1 is closed, that is, since the EMA rocker arm 15 has been pivoted in the anticlockwise direction as viewed in the figure, the piston 18*c* is positioned leftward, whereby the coil spring 18*g* is compressed, and the ball 18*f* closes the port 18*e*. From this state, when the intake valve IV1 is moved in the valve-opening direction, the EMA rocker arm 15 is pivoted in the clockwise direction, whereby the piston 18*c* is slid rightward. As the piston 18*c* is slid rightward, the ball 18*f* opens the port 18*e* to allow oil to fill the valve chamber 18*d*, and the coil spring 18*g* is expanded. Then, when the first intake valve IV1 is moved in the valve-closing direction after cancellation of the holding thereof by the EMA 17, the EMA rocker arm 15 is braked by the urging force of the coil spring 18*g* and the oil pressure, whereby the impact on the first intake valve IV1 is reduced.

On the other hand, a crankshaft angle sensor 30 (operating condition-detecting means, rotational speed-detecting means) is arranged around the crankshaft. The crankshaft angle sensor 30 generates a CYL signal, a TDC signal, and a CRK signal, as pulse signals, at respective predetermined crank angle positions to deliver the same to the ECU 2. The CYL signal (i.e. pulse thereof) is generated at a predetermined crank angle position of a particular cylinder. The TDC signal (i.e. pulse thereof) indicates that the piston (not shown) of each cylinder 4 is at a predetermined crank angle position in the vicinity of a TDC (top dead center) position from which the intake stroke starts, and in the case of the four-cylinder engine of the present embodiment, one pulse of the TDC signal is delivered whenever the crankshaft rotates through 180 degrees. Further, the CRK signal (i.e. pulse thereof) is generated at a shorter cycle than that of the TDC signal i.e. whenever the crankshaft rotates through e.g. 30 degrees.

The ECU 2 calculates a valve stage vlvStage representative of the crank angle position with respect to a reference crank angle position, on a cylinder-by-cylinder basis, based on these CYL, TDC, and CRK signals. More specifically, a valve stage vlvStage at which the CRK signal pulse is generated at the TDC position at the end of the compression stage is set to #0 stage, and thereafter, whenever the CRK signal pulse is generated (every 30 degrees of the crankshaft angle), the valve stage vlvStage is sequentially shifted to #1 stage, #2 stage, . . . , #23 stage. Further, the ECU 2 calculates the rotational speed of the engine 3 (hereinafter referred to as "the engine rotational speed") Ne based on the CRK signal.

Further, the ECU 2 receives a detection signal VLVONOFF indicative of the open/closed state of the first intake valve IV1, from a valve timing sensor 31. In the present embodiment, this valve timing sensor 31 is formed by a proximity switch which delivers an OFF signal indicative of the closed state of the first intake valve IV1 when the valve IV1 is within 1 mm of the fully-closed position, and an ON signal indicative of the open state of the same when the valve lift of the same is larger than in the above state. Thus, "closing" of the first intake valve IV1 is defined by a time point the valve lift thereof becomes equal to 1 mm from the fully-closed position (hereinafter referred to as "1 mm lift").

The ECU 2 further receives a detection signal indicative of a voltage VB (hereinafter referred to as "the power supply voltage") of the power source 28 (drive source) of the EMA 17 from a voltage sensor 32 (drive source condition-detecting means, power supply voltage-detecting means), a detection signal indicative of an accelerator opening ACC which is a stepped-on amount of an accelerator pedal (not shown) from an accelerator opening sensor 43, and respective detection signals indicative of an oil temperature Toil and an oil pressure Poil of hydraulic oil of the hydraulic impact-reducing mechanism 18 from an oil temperature sensor 34 and an oil pressure sensor 35, respectively.

The ECU 2 functions, in the present embodiment, as response delay-predicting means, output timing-setting means, holding timing control means, the operating condition-detecting means, and the rotational speed-detecting means, and is implemented by a microcomputer comprised of a CPU, a RAM, a ROM, and an I/O interface (none of which are shown). The aforementioned sensors 30 to 35 are inputted to the CPU after the I/O interface performs A/D conversion and waveform shaping thereon. Based on these input signals, in accordance with control programs read from the ROM, the CPU determines operating conditions of the engine 3, and set a target valve-closing timing VLCMD of the first intake valve IV1 optimum for the operating conditions of the engine according e.g. to the engine rotational speed Ne and the accelerator opening ACC. Further, the CPU carries out energization control of the EMA 17 such that the target valve-closing timing VLCMD can be obtained.

Figure 6:
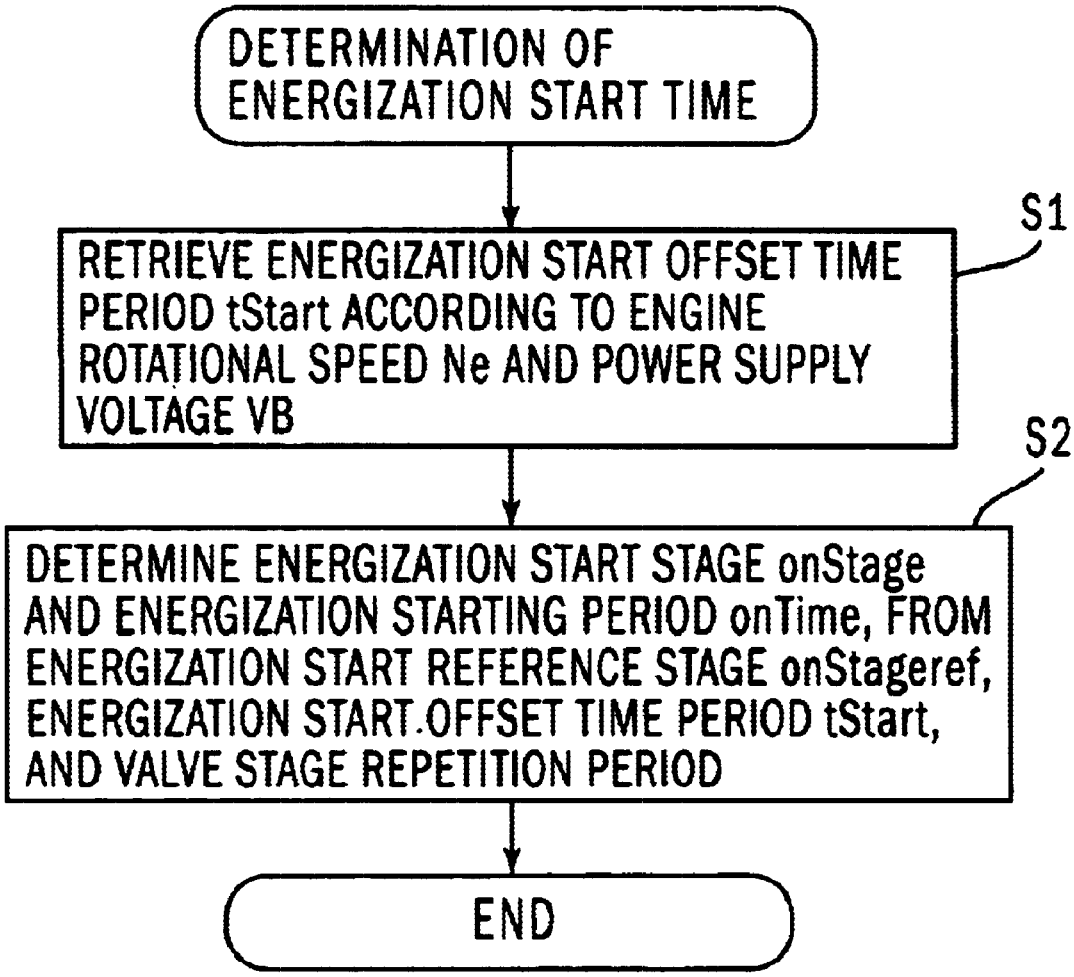
FIG. 6 is a flowchart of a process for determining an energization start time for starting the energization of the solenoid actuator.
Figure 13:
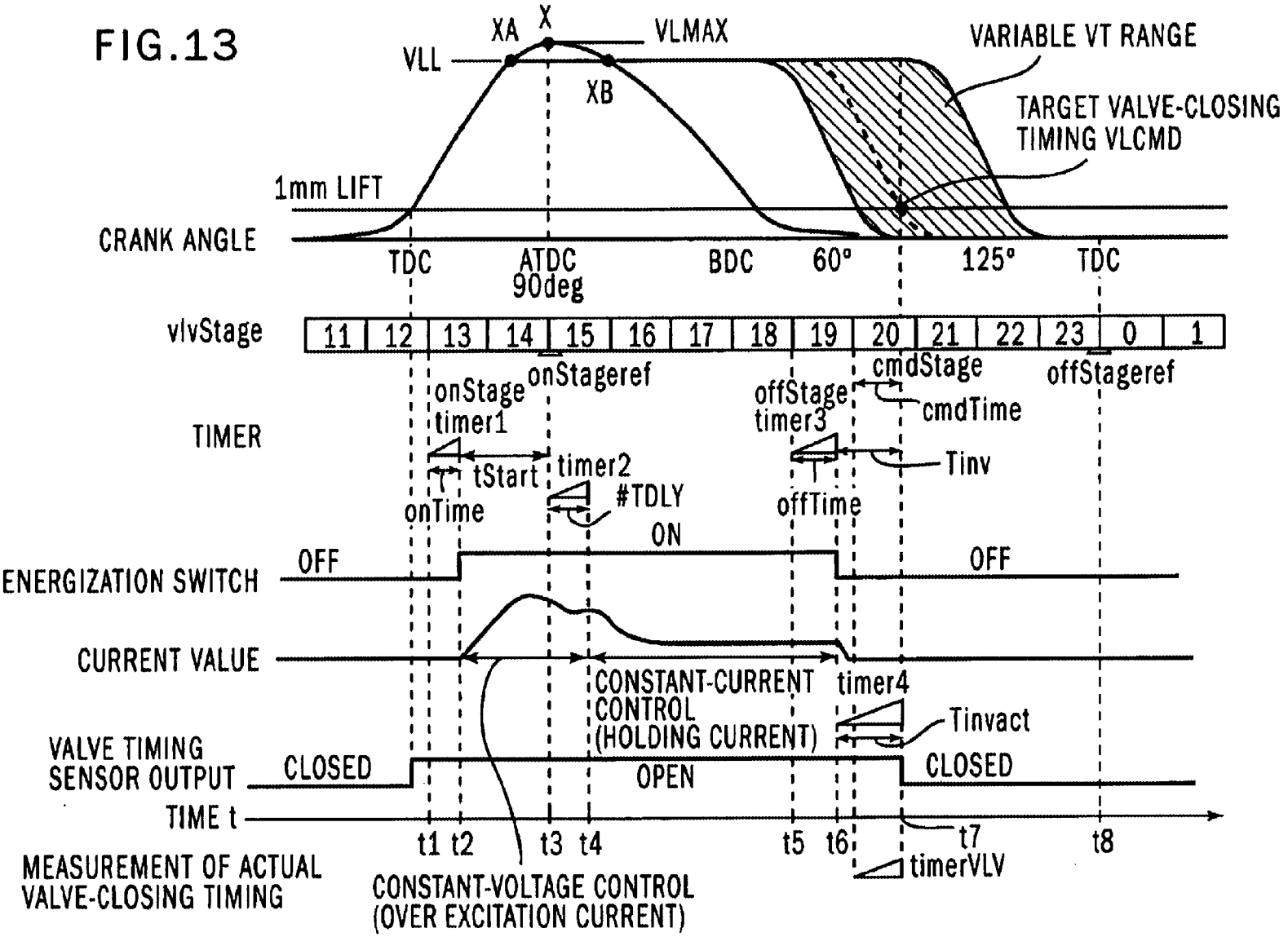
FIG. 13 is a timing chart showing an example of operations executed during the FIG. 12 energization control process.

FIG. 6 shows a flowchart of a process for determining an energization start time for the EMA 17. In this process, first in a step S1, a map shown in FIG. 7 is searched according to the engine rotational speed NE and the power supply voltage VB to thereby determine an energization start offset time tStart (response delay prediction value, output start offset time period). As shown in FIG. 13, this energization start offset time tStart corresponds to a time period over which the energization start timing (time t2) goes back from a energization start reference stage onStageref (e.g. #15 stage) (time t3) as a predetermined reference crank angle position, and hence as the value of the offset time tStart is larger, the energization start timing is earlier. Further, the energization start reference stage onStageref corresponds to the crank angle position at which the first intake valve IV1 reaches the maximum valve lift VLMAX (see FIG. 13).

In the FIG. 7 map, m×n tStart values are set in a manner associated with values of the engine rotational speed Ne and the power supply voltage VB, such that as the Ne value is larger and the VB value is smaller, the energization start offset time period tStart is set to a larger value. This is for the following reason: As the engine rotational speed Ne becomes higher, the rotational speed of the intake cam 11 also becomes higher, and in accordance therewith, the speed of change in a gap between the armature 24 moving in synchronism with the operation of the intake cam 11 and the yoke 21 becomes higher. In view of this, to prevent the magnetic flux of the electromagnet and the attractive force thereby from being delayed in rising behind the proper rising timing, the energization of the electromagnet 23 is started earlier by setting the energization start offset time period tStart to a larger value. Therefore, by using the map configured as described above, the energization start offset time period tStart can be set to the optimum value dependent on the engine rotational speed Ne and the power supply voltage VB, whereby the power consumption can be minimized, and it is possible to appropriately prevent the armature 24 from becoming incapable of holding the intake cam 11 due to delayed rise of the attractive force of the electromagnet 23 (hereinafter, this failure condition will be referred to as "loss of synchronization"), whereby the operation of holding the first intake valve IV1 by the EMA 17 can be ensured with stability.

Referring again to FIG. 6, in a step S2, by using the energization offset time tStart calculated in the step S1, and based on the energization start reference stage onStageref and a repetition period of the valve stage, an energization start stage onStage and an energization starting time period onTime (output timing) are determined, followed by terminating the present process. As shown in FIG. 13, this energization start stage onStage represents a valve stage vlvStage at which the energization of the EMA 17 should be started, and the energization starting time period onTime represents a time period after transition to the energization start stage onStage to actual start of the energization.

Figure 8:
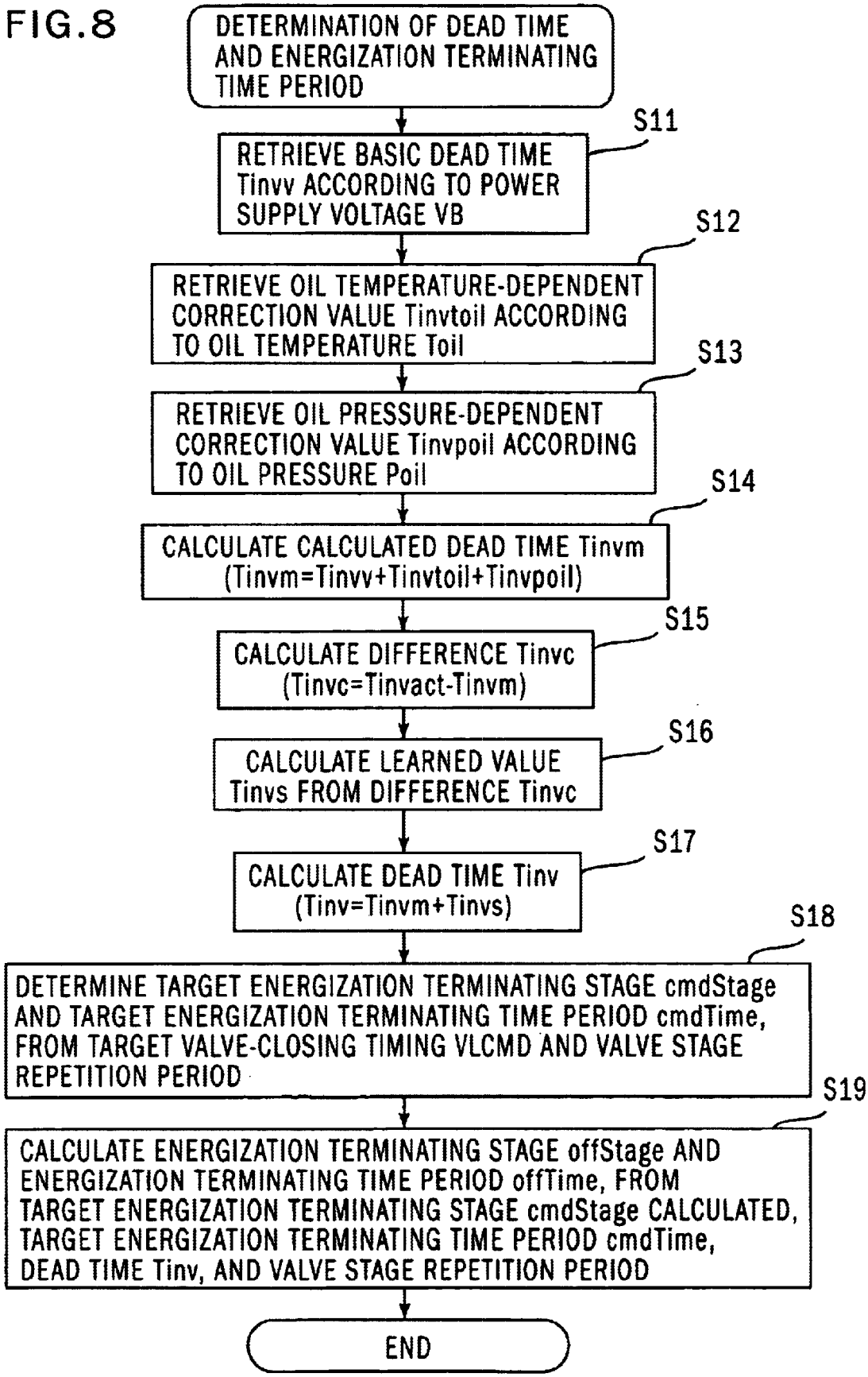
FIG. 8 is a flowchart of a process for determining a dead time and an energization terminating time period.

FIG. 8 is a flowchart showing a process for determining a dead time and an energization terminating time period. The dead Tinv is a time period it takes before the first intake valve IV1 is actually closed (the 1 mm lift is reached) after termination of the energization. As shown in FIG. 13, the energization is terminated at a time point (time t6) preceding the target valve-closing timing VLCMD (time t7) by the dead time Tinv.

Figure 9:
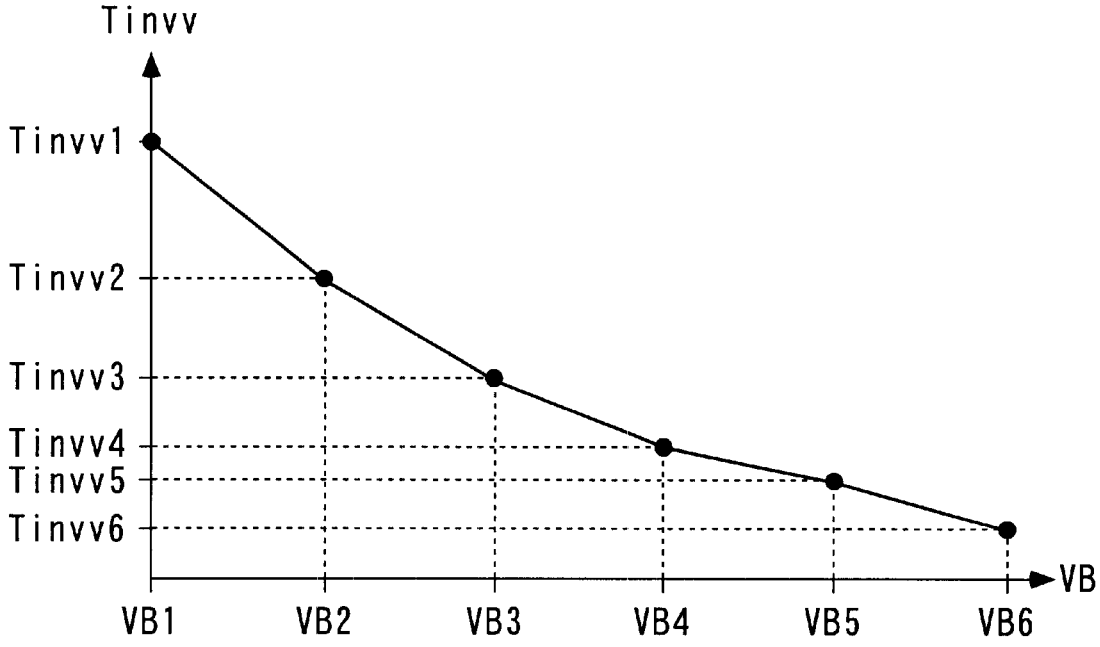
FIG. 9 is a diagram showing an example of a table for determining a basic time period of the dead time.

In this process, first, a table shown in FIG. 9 is searched according to the supply voltage VB to determine a basic time period Tinvv of the dead time Tinv (step S11). In this table, six predetermined values Tinvv1 to Tinvv6 are set in a manner associated with six grid points VB1 to VB6 of the power supply voltage VB, such that as the power supply voltage VB is lower, the basic time period Tinvv is set to a larger value. This is because as the power supply voltage VB is lower, the magnetic flux and the attractive force thereby are delayed in falling to delay the closing of the first intake valve IV1.

Figure 10:
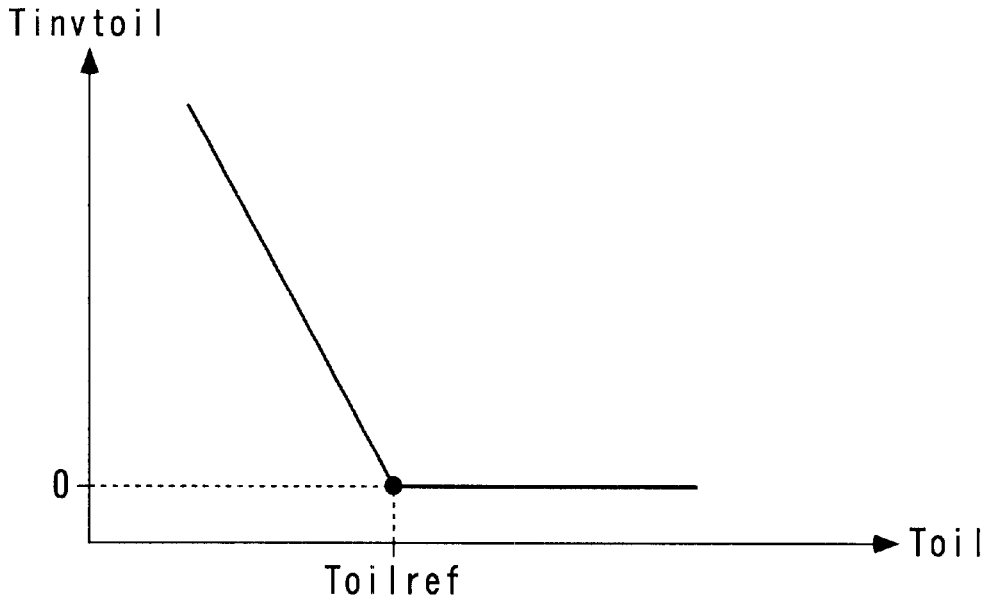
FIG. 10 is a diagram showing an example of a table for determining an oil temperature-dependent correction value for the dead time.

Next, in accordance with the oil temperature Toil of the hydraulic impact-reducing mechanism 18 detected by the oil temperature sensor 34, a table shown in FIG. 10 is searched to determine an oil temperature-dependent correction value Tinvtoil (step S12). In this table, with reference to a predetermined reference oil temperature Toilref (e.g. 50° C.), the correction value Tinvtoil is set to a value of 0 when the oil temperature Toil is equal to or higher than the predetermined reference oil temperature Toilref, while when the oil temperature Toil is lower than the predetermined reference oil temperature Toilref, the correction value Tinvtoil is set to a larger positive value as the Toil value is lower. This is because as the oil temperature Toil is lower, the viscosity of the hydraulic oil becomes higher, so that the operation of the piston 18*c* of the hydraulic impact-reducing mechanism 18 becomes slow, causing delayed closing of the first intake valve IV1.

Figure 11:
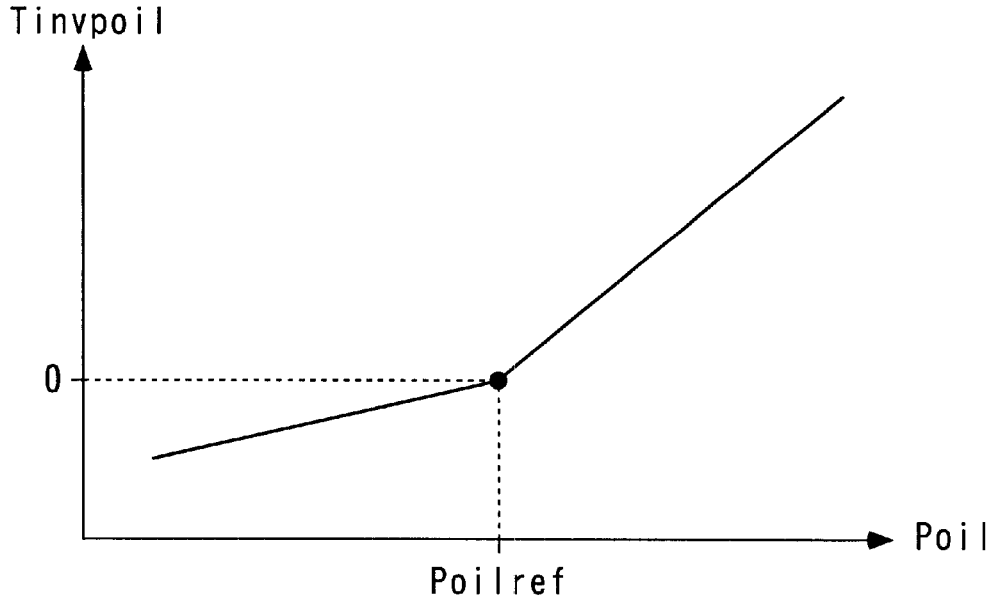
FIG. 11 is a diagram showing an example of a table for determining an oil pressure-dependent correction value for the dead time.

Next, according to the oil pressure Poil of the hydraulic impact-reducing mechanism 18 detected by the oil pressure sensor 35, a table shown in FIG. 11 is searched to determine an oil pressure-dependent correction value Tinvpoil (step S13). In this table, with reference to a predetermined reference oil pressure Poilref (e.g. 0.10 MPa), the correction value Tinvpoil is set to a value of 0 when the oil pressure Poil is equal to the predetermined reference oil pressure Poilref. Further, when the oil pressure Poil is higher than the predetermined reference oil pressure Poilref, the correction value Tinvpoil is set to a larger positive value as the Poil value is higher, while when the oil pressure Poil is lower than the predetermined reference oil pressure Poilref, the correction value Tinvpoil is set to a larger negative value (negative value larger in its absolute value) as the Poil value is lower. This configuration enables the oil pressure-dependent correction value Tinvpoil to be properly set according to the oil pressure resistance of the hydraulic impact-reducing mechanism 18.

Next, the oil temperature-dependent correction value Tinvtoil and the oil pressure-dependent correction value Tinvpoil calculated in the steps S12, S13 are added to the basic time period Tinvv calculated in the step S11 to calculate a calculated dead time Tinvm (=Tinvv+Tinvtoil+Tinvpoil) (step S14). Next, the difference Tinvc (=Tinvact−Tinvm) between a dead time actually measured as described hereinafter (hereinafter referred to as "the actual dead time") Tinvact and the calculated dead time Tinvm (=Tinvact−Tinvm) is calculated (step S15).

Next, based on the difference Tinvc, a learned value Tinvc is calculated (step S16). The learned value Tinvs is calculated for compensation of a possible lowering in the control accuracy of the valve-closing timing of the first intake valve IV1, which can be caused by deviation of the actual dead time from the calculated dead time Tinvm due to variation among individual products, assembly error, aging, etc. of the EMA 17, even if the calculated dead time Tinvm is determined from the known parameters as described above. More specifically, the learned value Tinvs is calculated by an averaging calculation in which an averaging coefficient is applied to the difference Tinvc, for ensuring stability of the calculation.

Next, the learned value Tinvs thus calculated is added to the calculated dead time Tinvm to calculate a final dead time Tinv (=Tinvm+Tinvs) (step S17).

Next, based on the target valve-closing timing VLCMD and the repetition period of the valve stage, a target energization terminating stage cmdStage and a target energization terminating time period cmdTime corresponding to the former parameter of the target valve timing VLCMD are determined (step S18). The target energization terminating stage cmdStage represents a valve stage vlvStage at which the closing of the first intake valve IV1 should be completed, and the target energization terminating time period cmdTime represents a time period it takes before the closing of the first intake valve IV1 is completed after transition to the target energization terminating stage cmdStage (see FIG. 13).

Next, based on the target energization terminating stage cmdStage and the target energization terminating time period cmdTime thus calculated, the dead time Tinv determined in the step S17, and the repetition period of the valve stage, the energization terminating stage offStage and the energization terminating time period offTime are calculated (step S19), followed by terminating the process. As shown in FIG. 13, the energization terminating stage offStage represents a valve stage vlvsStage at which the energization should be terminated and the energization terminating time period offTime represents a time period from transition to the energization terminating stage offStage to the actual termination of the energization.

Figure 12:
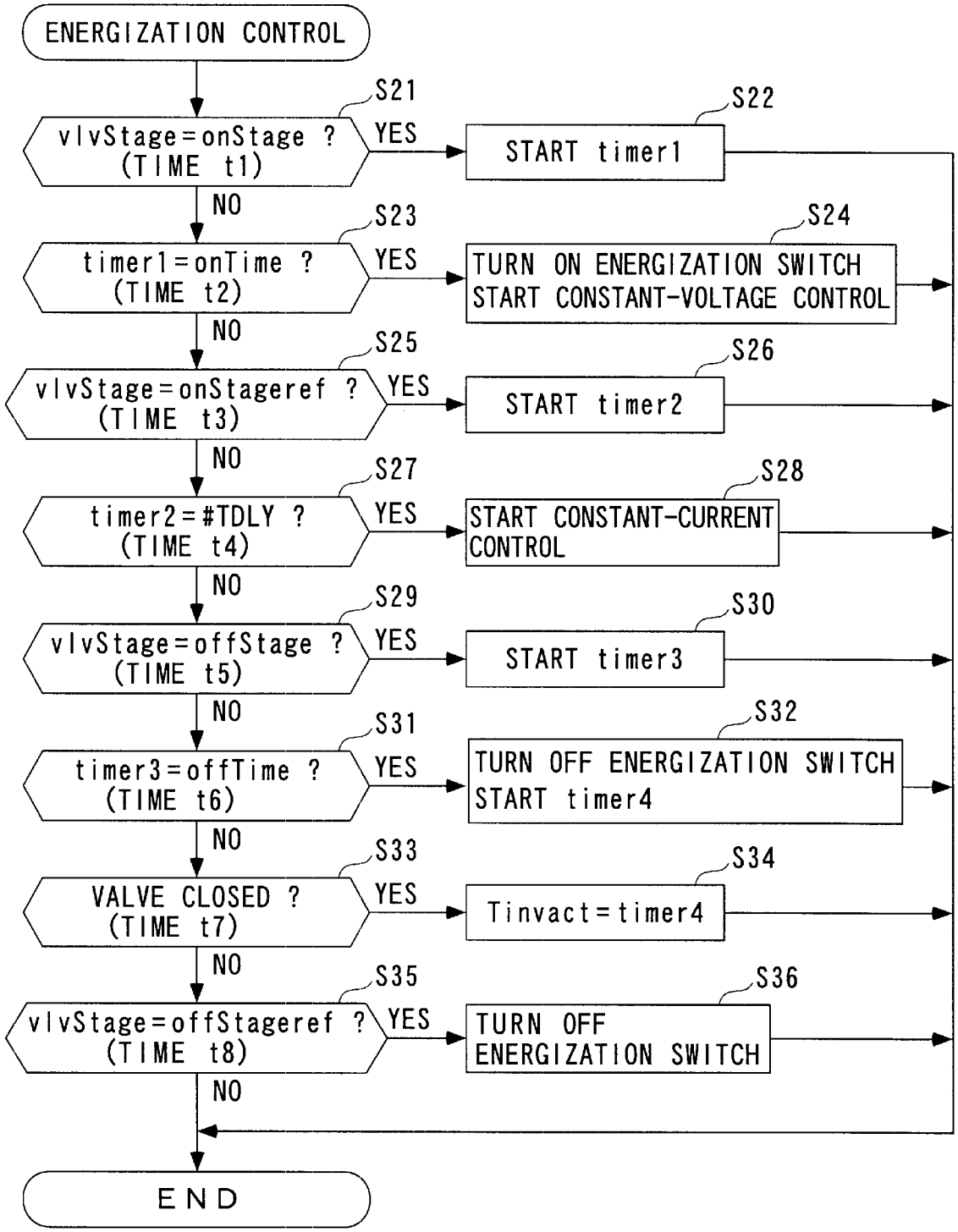
FIG. 12 is a flowchart of an energization control process for the solenoid actuator.

FIG. 12 shows an energization control process for controlling the energization of the electromagnet 23 of the EMA 17. Hereinafter, the energization control process will be described with reference to a timing chart shown in FIG. 13, illustrating an example of operations of the valve timing control system.

In the present process, it is determined whether or not the valve stage vlvStage has reached the energization start stage onStage determined in the step S2 in FIG. 6 (step S21). When the answer to this question becomes affirmative (YES), an energization start timer time1 (output start timer) of an up-count type is started (step S22). Next, it is determined whether or not the value of the energization start timer timer1 becomes equal to the energization starting time period onTime (step S23). When the answer to this question becomes affirmative (YES), i.e. when the energization starting time period onTime has elapsed after transition to the energization start stage onStage (time t2), the energization switch 27 is turned on to start energization of the EMA 17 by constant-voltage control whereby over excitation current is supplied to the EMA 17 (step S24). Thus, the constant-voltage control is carried out at the start of energization of the EMA 17 to supply over excitation current whereby toughness against a disturbance is imparted to the EMA 17. This makes it possible to cause the EMA 17 to properly hold the first intake valve IV1.

Next, it is determined whether or not the valve stage vlvStage has reached the energization start reference stage onStageref (step S25), and when the answer to this question becomes affirmative (YES) (time t3), an energization switching delay timer timer2 is started (step S26). Then, it is determined whether or not the value of the energization delay timer timer2 is equal to a predetermined time period #TDLY (e.g. 1 millisecond)(step S27). When the answer to this question becomes affirmative (YES), i.e. when the predetermined time period #TDLY has elapsed after transition to the energization start reference stage onStageref (time t4), the energization of the EMA 17 is switched from the constant-voltage control to the constant-current control to thereby supply a smaller and fixed amount of holding current to the EMA 17 (step S28).

After transition to the energization start reference stage onStageref, i.e. when the operation of attracting the armature 24 to the electromagnet 23 to hold thereat is completed, the distance between the two 23, 24 becomes constant, and hence even if the control is switched to the constant-current control by a smaller amount of holding current, it is possible to continue to positively hold the armature 24 and at the same time reduce the power consumed for the holding. Further, after transition to the energization start reference stage onStageref, by continuing the constant-voltage control until the predetermined time period #TDLY has elapsed, it is possible to positively attract and hold the armature 24.

Next, it is determined whether or not the energization terminating stage offStage calculated in the step S19 in FIG. 8 is reached (step S29). When the answer to this question becomes affirmative (time t5), an energization terminating timer timer3 is started (step S30). Next, it is determined whether or not the value of the energization terminating timer timer3 is equal to the energization terminating time period offTime (step S31). When the answer to this question becomes affirmative (YES), i.e. when the energization terminating time period offTime has elapsed (time t6) after transition to the energization terminating stage offStage, the energization switch 27 is turned off to thereby terminate the energization of the EMA 17, and at the same time, a dead time measurement timer timer4 is started (step S32).

Next, from a result of detection by the valve timing sensor 31, it is determined whether or not the first intake valve IV1 has been actually closed (the 1 mm lift has been reached) (step S33). When the answer to this question becomes affirmative (YES) (time t7), the value of the dead time measurement timer timer4 at this time is set to the actual dead time Tinvact (step S34). As described hereinbefore, the actual dead time Tinvact is used for calculation of the learned value Tinvs of the dead time Tinv.

Next, it is determined whether or not the valve stage vlvStage has reached an energization forced termination stage offStageref (e.g. #0 stage) (step S35). When the answer to this question becomes affirmative (YES), irrespective of the result of detection by the valve timing sensor 31, the energization switch 27 is turned off, whereby the energization of the EMA 17 is forcedly terminated (step S36), followed by terminating the present process.

As described above, according to the valve timing control system 1 of the present embodiment, as the engine rotational speed Ne is higher and the power supply voltage VB is lower, the energization start offset time period tStart is set to a larger value, thereby starting the energization of the EMA 17 earlier. This makes it possible to start the operation of the EMA 17 in appropriate timing dependent on the rotational speed of the engine 3 and the power supply voltage of the power source 28, and hence even under a high rotational speed condition of the engine 3 and a lower voltage condition of the power source 28, the EMA 17 can be efficiently operated without delay, whereby the first intake valve IV1 can be properly held.

Further, the energization start timer timer1 counts the energization starting time period onTime terminating at a time point preceding the energization start reference stage onStageref by the energization start offset time period tStart, to thereby start the energization when the time period onTime is counted up. This makes it possible to start the energization of the EMA 17 in proper timing with accuracy in a manner made synchronous with the rotation of the intake cam 11, and at the same time properly complete the holding operation by the time the energization start reference stage onStageref is reached. Further, when the energization of the EMA 17 is started, the constant-voltage control is carried out to supply over excitation current, which makes it possible to hold the first intake valve IV1 more appropriately. After the first intake valve IV1 is held, the control is switched to the constant-current control by a smaller holding current, which makes it possible to continue to positively hold the first intake valve IV1 while reducing the power consumption.

Further, the dead time Tinv is calculated based on the power supply voltage VB, the oil temperature Toil, and the oil pressure Poil, and the energization is stopped at the end of the energization terminating time period offTime, i.e. a time point preceding the target valve-closing timing TVLCMD by the dead time Tinv, which makes it possible to accurately close the first intake valve IV1 in the target valve-closing timing VLCMD.

Figure 14:
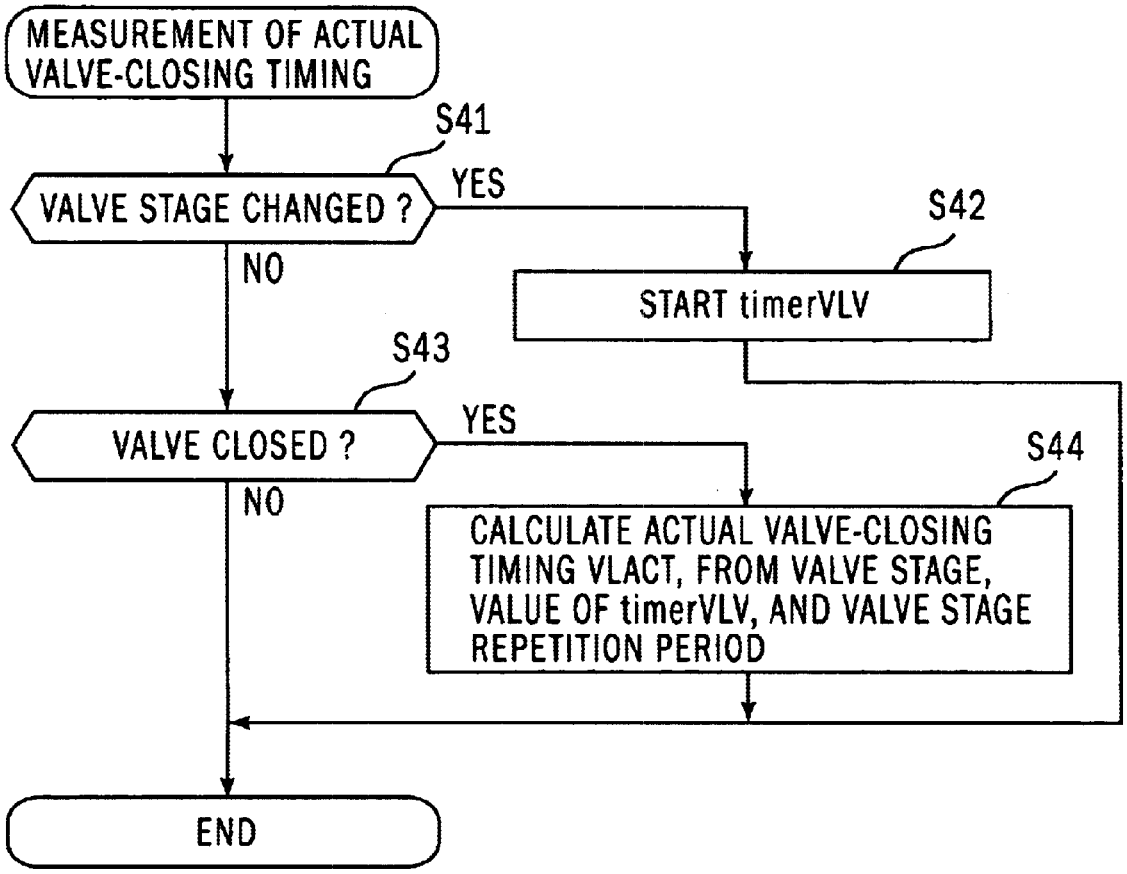
FIG. 14 is a flowchart of a process for measuring actual valve-closing timing.

Although in the FIG. 8 process described above, the learned value Tinvs is calculated based on the actual dead time Tinvact and the calculated dead time Tinvm, this is not limitative, but instead of this, the learned value Tinvs may be calculated based on the difference between measured valve-closing timing VLACT in which the first intake valve IV1 is actually closed (hereinafter referred to as "the actual valve-closing timing") and the target valve-closing timing VLCMD, FIG. 14 is a flowchart showing a process for measuring the actual valve-closing timing of the first intake valve IV1.

In this process, first, it is determined whether or not the valve stage vlvStage has been changed (shifted) (step S41). If the answer to this question is affirmative (YES), a valve-closing timing measuring timer timerVLV is started (step S42). Thus, the valve-closing timing measuring timer timerVLV is reset whenever the valve stage vlvStage is changed. If the answer to the question of the step S41 is negative (NO), it is determined from a result of the detection of the valve timing sensor 31 whether or not the first intake valve IV1 has been closed (step S43). If the answer to this question is negative (NO), the process is immediately terminated.

On the other hand, if the answer to the question of the step S43 is affirmative (YES), i.e. if the first intake valve IV1 is closed (time t7 in FIG. 13), the actual valve-closing timing VLACT is determined based on the valve stage vlvStage at this time, the value of the valve-closing timing measuring timer timerVLV, and the repetition period of the valve stage (step S44), followed by terminating the present process. The actual valve-closing timing VLACT thus determined represents timing in which the first intake valve IV1 is actually closed, and hence from the difference between this timing and the target valve-closing timing VLCMD, the learned value of the dead time can be properly calculated.

Figure 15:
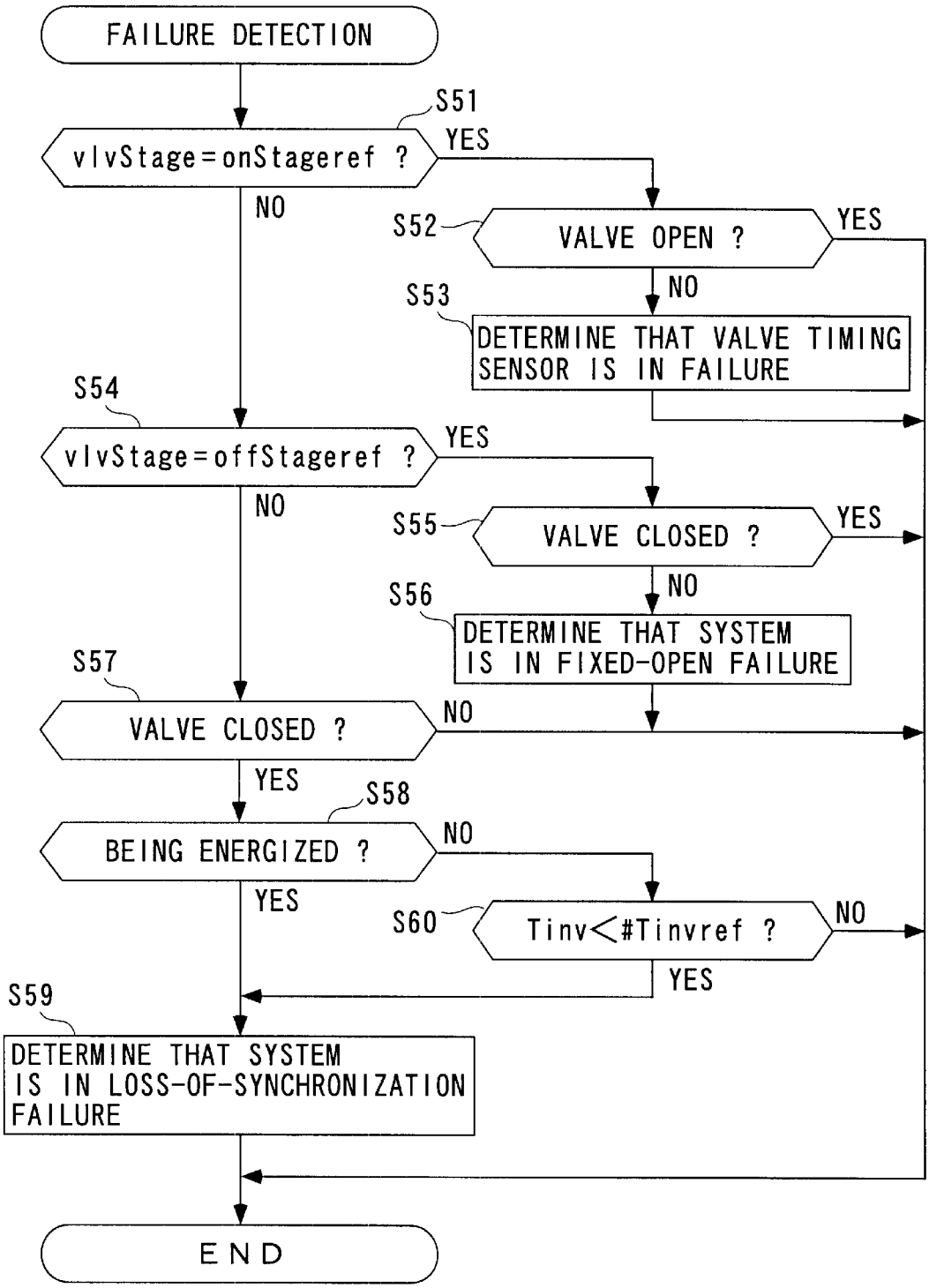
FIG. 15 is a flowchart of a process for detecting a failure of the valve timing control system or a failure of a device associated therewith.
Figure 16:
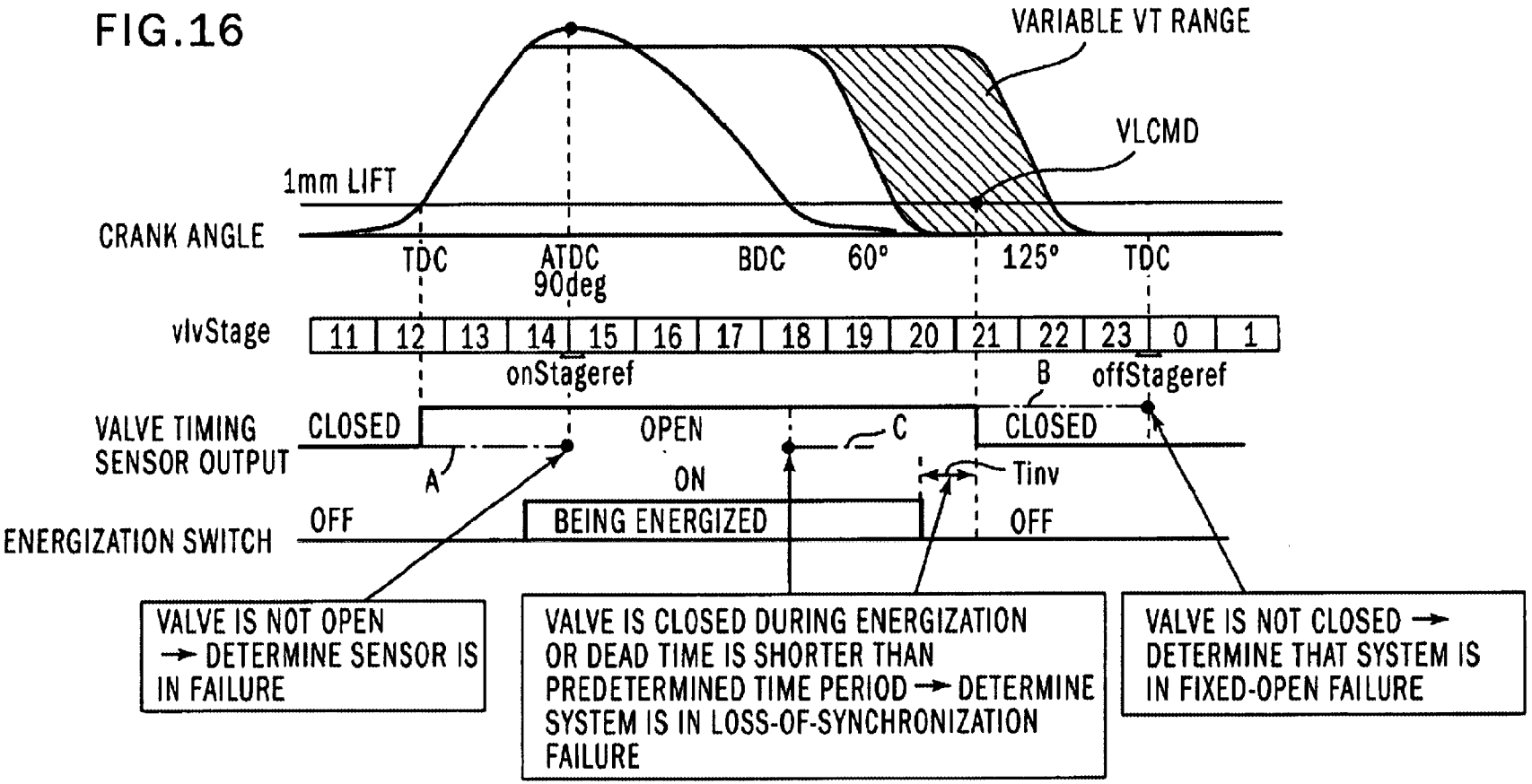
FIG. 16 is a timing chart illustrating an example of detection of failures by the FIG. 15 detecting process.

FIG. 15 is a flowchart showing a failure-detecting process for detecting a failure of the valve timing control system 1 or a failure of a device associated therewith. Hereinafter, this failure-detecting process will be described while referring to a timing chart shown in FIG. 16, illustrating an example of operations carried out in the process.

In this process, first, it is determined whether or not the valve stage vlvStage is the energization start reference stage onStageref (step S51). If the answer to this question is affirmative (YES), it is determined from a result of detection by the valve timing sensor 31 whether or not the first intake valve IV1 is open (step S52). If the answer to this question is affirmative (YES), the process is immediately terminated. On the other hand, if the answer to the question of the step S52 is negative (NO), it is determined in a step S53 that the valve timing sensor 31 is in failure, since in spite of the fact that the valve stage vlvStage is the energization start reference stage onStageref, and hence the first intake valve IV1 should have necessarily been opened by the cam-type valve actuating mechanism 7, the result of the detection by the sensor 31 is contradictory to this (state indicated by one-dot-chain line A in FIG. 16).

If the answer to the question of the step S51 is negative (NO), it is determined whether or not the valve stage vlvStage is the energization forced termination stage offStageref (step S54). If the answer to this question is affirmative (YES), it is determined whether or not the intake valve IV1 has been closed (step S55). If the answer to this question is affirmative (YES), the present process is immediately terminated. On the other hand, if the answer to the question of the step S54 is negative (NO), it is determined in a step S56 that the valve timing control system 1 is in the failure of a fixed open state, since in spite of the fact that the valve stage vlvStage is the energization forced termination stage offStageref, and hence the first intake valve IV1 should have necessarily been closed by the valve timing control system 1, it is actually open (state indicated by one-dot-chain line B in FIG. 16).

If the answer to the question of the step S54 is negative (NO), it is determined whether or not the intake valve IV1 has been closed (step S57). If the answer to this question is negative (NO), the present process is immediately terminated. On the other hand, if the answer to the question of the step S57 is affirmative (YES), it is determined whether or not the EMA 17 is being energized (step S58). If the answer to this question is affirmative (YES), it is determined in a step S59 that the valve timing control system 1 is in the failure of loss of synchronization, since in spite of the fact that the first intake valve IV1 should have been open due to the energization of the EMA 17, it is actually closed (state indicated by one-dot-chain line C in FIG. 16).

Further, if the answer to the question of the step S58 is negative (No), i.e. if the EMA 17 is not being energized, it is determined whether or not the dead time Tinv calculated in the step S17 in FIG. 8 is smaller than a predetermined time period #Tinvref (e.g. 5 to 8 milliseconds) (step S60). If the answer to this question is negative (NO), the present process is terminated, whereas if the answer to the question of the step S60 is affirmative (YES), it is judged that the dead time Tinv is abnormally short, and hence there is a fear that the first intake valve IV1 has already been closed when the energization of the EMA 17 is terminated, so that the process proceeds to the step S59 to also determine that the valve timing control system 1 is in the failure of loss of synchronization.

As described heretofore, according to the failure-detecting process, from the relationship between the valve stage vlvStage and the result of detection by the valve timing sensor 31, it is possible to detect a failure of the valve timing control system 1 and that of the valve timing sensor 31.

It should be noted that the present invention is not limited to the embodiment described above, but can be embodied in various forms. For example, although in the above embodiment, the reference crank angle position with reference to which the energization of the EMA 17 is started is set to the energization start reference stage onStageref (#15 stage), i.e. a crank angle position corresponding to the maximum valve lift VLMAX of the first intake valve IV1 (point X in FIG. 13), this is not limitative, but the same may be set to a crank angle position on an earlier side or a later side of the seating of the armature 24 on the yoke 21 (point XA or XB in FIG. 13). If the reference crank angle position is set to the earlier point XA, the energization can be started earlier accordingly, so that a longer energization time period can be secured, which makes it possible to hold the first intake valve IV1 more positively, whereas when it is set to the later point XB, the energization is delayed as much as possible, which makes it possible to save the power consumption as much as possible.

Further, although in the above embodiment, the solenoid actuator is employed as the actuator for holding the valve, this is not limitative, but any other suitable actuator can be employed, such as a hydraulic actuator or an air actuator. In such a case, it is preferred that the response delay of the actuator is predicted by taking into account the rising characteristic of the type of the actuator. More specifically, it is preferred that an output start offset time period by which is shifted the start of delivery of the drive signal to the actuator, corresponding to the energization start offset time period tStart of the embodiment, is set depending on the oil temperature in the case of the hydraulic actuator such that it is set to a larger value as the oil temperature Toil is lower, and depending on the atmospheric density (temperature or atmospheric pressure) in the case of the air actuator such that it is set to a larger value as the atmospheric density is lower.

It is further understood by those skilled in the art that the foregoing is a preferred embodiment of the invention, and that various changes and modification may be made without departing from the spirit and scope thereof.

What is claimed is:

1. A valve timing control system for an internal combustion engine, for controlling valve-closing timing of a valve opened by a cam provided on a camshaft, by temporarily holding the valve, the valve timing control system comprising:

an actuator for holding the valve;

response delay-predicting means for predicting a response delay of said actuator by a response delay prediction value;

output timing-setting means for setting output timing in which a drive signal for driving said actuator is output, according to the predicted response delay prediction value; and holding timing control means for controlling holding timing in which the valve is held by said actuator, by outputting the drive signal to said actuator, based on the set output timing.

2. A valve timing control system according to claim 1, further comprising operating condition-detecting means for detecting an operating condition of the engine, and wherein said response delay-predicting means predicts the response delay of said actuator according to the detected operating condition of the engine.

3. A valve timing control system according to claim 2, wherein said operating condition-detecting means includes rotational speed-detecting means for detecting a rotational speed of the engine as the operating condition of the engine, wherein said response delay-predicting means sets the response delay prediction value to a larger value as the detected rotational speed of the engine is higher.

4. A valve timing control system according to claim 1, further comprising drive source condition-detecting means for detecting a condition of a drive source of said actuator, wherein said response delay-predicting means predicts the response delay of said actuator, according to the detected condition of the drive source.

5. A valve timing control system according to claim 2, further comprising drive source condition-detecting means for detecting a condition of a drive source of said actuator, wherein said response delay-predicting means predicts the response delay of said actuator, according to the detected condition of the drive source.

6. A valve timing control system according to claim 3, further comprising drive source condition-detecting means for detecting a condition of a drive source of said actuator, wherein said response delay-predicting means predicts the response delay of said actuator, according to the detected condition of the drive source.

7. A valve timing control system according to claim 4, wherein said actuator is formed by a solenoid actuator, wherein said drive source condition-detecting means includes power supply voltage-detecting means for detecting a voltage of a power source of said solenoid actuator, as the condition of said drive source, and wherein said response delay-predicting means sets the response delay prediction value to a larger value as the detected voltage of said power source is lower.

8. A valve timing control system according to claim 5, wherein said actuator is formed by a solenoid actuator, wherein said drive source condition-detecting means includes power supply voltage-detecting means for detecting a voltage of a power source of said solenoid actuator, as the condition of said drive source, and wherein said response delay-predicting means sets the response delay prediction value to a larger value as the detected voltage of said power source is lower.

9. A valve timing control system according to claim 6, wherein said actuator is formed by a solenoid actuator, wherein said drive source condition-detecting means includes power supply voltage-detecting means for detecting a voltage of a power source of said solenoid actuator, as the condition of said drive source, and wherein said response delay-predicting means sets the response delay prediction value to a larger value as the detected voltage of said power source is lower.

10. A valve timing control system according to claim 7, wherein said solenoid actuator includes an armature that is moved to follow motion of the valve when the valve is lifted by the cam in a valve-opening direction, and an electromagnet that is energized when said armature is close thereto, by electric power supplied as the drive signal from said power source, to thereby attract said armature thereto to hold the valve, and wherein said holding timing control means controls the electric power supplied to said electromagnet by constant voltage before the valve is held, and by constant current after the valve is held.

11. A valve timing control system according to claim 8, wherein said solenoid actuator includes an armature that is moved to follow motion of the valve when the valve is lifted by the cam in a valve-opening direction, and an electromagnet that is energized when said armature is close thereto, by electric power supplied as the drive signal from said power source, to thereby attract said armature thereto to hold the valve, and wherein said holding timing control means controls the electric power supplied to said electromagnet by constant voltage before the valve is held, and by constant current after the valve is held.

12. A valve timing control system according to claim 9, wherein said solenoid actuator includes an armature that is moved to follow motion of the valve when the valve is lifted by the cam in a valve-opening direction, and an electromagnet that is energized when said armature is close thereto, by electric power supplied as the drive signal from said power source, to thereby attract said armature thereto to hold the valve, and wherein said holding timing control means controls the electric power supplied to said electromagnet by constant voltage before the valve is held, and by constant current after the valve is held.

13. A valve timing control system according to claim 1, wherein said response delay-predicting means calculates an output start offset time period by which a start of output of the drive signal to said actuator is shifted, as the response delay prediction value, and wherein said output timing-setting means includes an output start timer that counts up to a time going back from a reference time corresponding to a predetermined reference crank angle position by the output start offset time period, thereby causing the drive signal to start to be output to said actuator at the time.

14. A valve timing control system according to claim 2, wherein said response delay-predicting means calculates an output start offset time period by which a start of output of the drive signal to said actuator is shifted, as the response delay prediction value, and wherein said output timing-setting means includes an output start timer that counts up to a time going back from a reference time corresponding to a predetermined reference crank angle position by the output start offset time period, thereby causing the drive signal to start to be output to said actuator at the time.

15. A valve timing control system according to claim 3, wherein said response delay-predicting means calculates an output start offset time period by which a start of output of the drive signal to said actuator is shifted, as the response delay prediction value, and wherein said output timing-setting means includes an output start timer that counts up to a time going back from a reference time corresponding to a predetermined reference crank angle position by the output start offset time period, thereby causing the drive signal to start to be output to said actuator at the time.

16. A valve timing control system according to claim 4, wherein said response delay-predicting means calculates an output start offset time period by which a start of output of the drive signal to said actuator is shifted, as the response delay prediction value, and wherein said output timing-setting means includes an output start timer that counts up to a time going back from a reference time corresponding to a predetermined reference crank angle position by the output start offset time period, thereby causing the drive signal to start to be output to said actuator at the time.

17. A valve timing control system according to claim 7, wherein said response delay-predicting means calculates an output start offset time period by which a start of output of the drive signal to said actuator is shifted, as the response delay prediction value, and wherein said output timing-setting means includes an output start timer that counts up to a time going back from a reference time corresponding to a predetermined reference crank angle position by the output start offset time period, thereby causing the drive signal to start to be output to said actuator at the time.

18. A valve timing control system according to claim 10, wherein said response delay-predicting means calculates an output start offset time period by which a start of output of the drive signal to said actuator is shifted, as the response delay prediction value, and wherein said output timing-setting means includes an output start timer that counts up to a time going back from a reference time corresponding to a predetermined reference crank angle position by the output start offset time period, thereby causing the drive signal to start to be output to said actuator at the time.

* * * * *